United States Patent [19]

Keith et al.

[11] 4,301,512

[45] Nov. 17, 1981

[54] TEST DEVICE FOR BLOOD PRESSURE MONITOR

[75] Inventors: Everette R. Keith, Southfield; Kenneth J. Cook, Troy; Joseph S. Power, Fraser; Frederick B. Ruszala, Sterling Heights, all of Mich.

[73] Assignee: The Valeron Corporation, Troy, Mich.

[21] Appl. No.: 93,087

[22] Filed: Nov. 9, 1979

[51] Int. Cl.[3] ..... G06G 7/48

[52] U.S. Cl. ..... 364/801; 128/668; 235/92 EA; 235/92 MT; 340/753; 364/416; 364/578

[58] Field of Search ..... 235/92 MS, 92 EA, 92 MT; 364/415-417, 578, 579, 580, 801; 128/668, 672, 695, 699; 340/753, 754, 802

[56] References Cited

U.S. PATENT DOCUMENTS

| | | | |
|---|---|---|---|
| 3,267,934 | 8/1966 | Thornton | 128/702 |
| 3,319,623 | 5/1967 | London | 128/696 |
| 3,323,068 | 5/1967 | Woods | 328/187 |
| 3,384,981 | 5/1968 | Baessler et al. | 35/17 |
| 3,552,036 | 1/1971 | Mahler | 35/17 |
| 3,736,363 | 5/1973 | Baessler et al. | 35/17 |
| 3,757,778 | 9/1973 | Graham | 128/696 |
| 3,806,911 | 4/1974 | Pripusich | 340/802 |
| 3,938,051 | 2/1976 | Eisenberg | 328/187 |
| 4,203,103 | 5/1980 | Osada et al. | 340/753 |
| 4,204,261 | 5/1980 | Ruszala et al. | 364/578 |

*Primary Examiner*—Errol A. Krass
*Attorney, Agent, or Firm*—Krass, Young & Schivley

[57] ABSTRACT

A device for testing the operability of a blood pressure monitor. The device includes a signal generator for generating a plurality of different output signals simulating a variety of static blood pressure levels. A plurality of display devices are included, each device corresponding to one of the given static blood pressure levels. Control circuitry coupled to a single push button switch simultaneously selects a different blood pressure level to be generated and energizes its corresponding display device upon each sequential activation of the switch.

15 Claims, 3 Drawing Figures

TEST DEVICE FOR BLOOD PRESSURE MONITOR

BACKGROUND OF THE INVENTION

This invention relates to test devices and, more particularly, to a device for testing the operability of a blood pressure monitor.

In U.S. Ser. No. 938,430, filed Aug. 31, 1978, (now U.S. Pat. No. 4,205,386) entitled "Electrocardiographic and Blood Pressure Waveform Simulator Device", assigned to the assignee of the present invention, there is disclosed a battery operated device for generating a plurality of different static blood pressure signals for testing the operability of a blood pressure monitor. The different static blood pressure levels were selected by pressing separate buttons on the housing of the simulator device. This device has provided extremely satisfactory results. However, the use of the many different selector switches added to the manufacturing costs of the device and was somewhat inconvenient to the user. It was also important to insure that each separate switch was operating properly so that each one makes the proper electrical connection. Although the switches were labeled, it was often not readily apparent to the user exactly which static blood pressure level was being generated. Moreover, the battery has a tendency to run down if the user did not press the correct power switch to turn the device off after use.

SUMMARY OF THE INVENTION

The present invention provides unique improvements to the device disclosed in above-identified patent application. According to the present invention, means are provided for generating a plurality of different output signals corresponding to different static blood pressure levels for testing the operability of a blood pressure monitor. A plurality of display devices are also included, with each device corresponding to one of the generated static blood pressure levels. Control means are coupled to a push button switch. The control means is operative for simultaneously selecting a different blood pressure level and energizing its corresponding display device upon each sequential activation of the switch. Preferably, there is only one switch provided for the device and it controls on/off functions as well as the level selector function noted above. Another aspect of this invention includes the provision of an automatic shut-off timer which automatically removes power from the electrical circuitry if the switch is not activated within a predetermined time period thereby preserving battery power.

BRIEF DESCRIPTION OF THE DRAWINGS

These and other objects and advantages of the present invention will become apparent upon reading the following specification and by reference to the drawings in which.

DESCRIPTION OF THE PREFERRED EMBODIMENT

Figure 1:
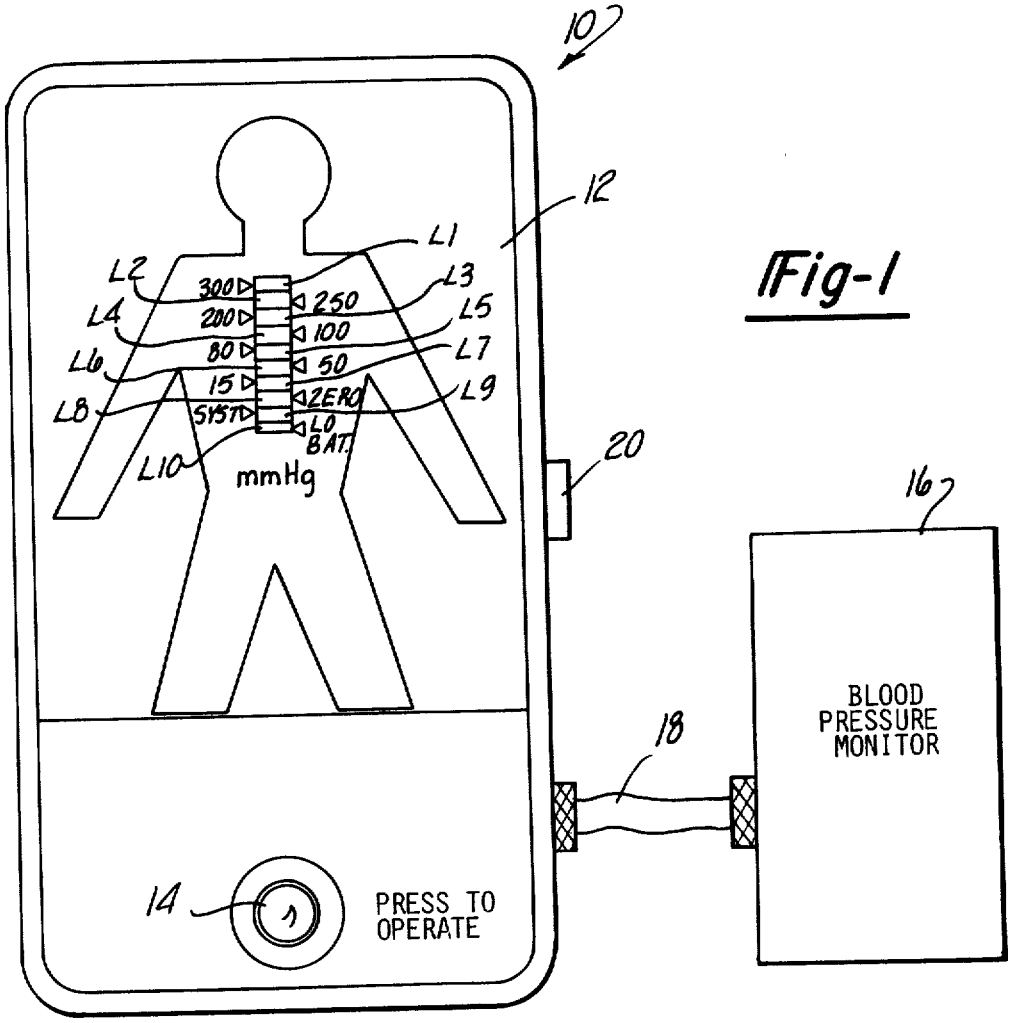
FIG. 1 is a top plan view of a device made according to the teachings of the present invention in use with a blood pressure monitor.
Figure 2:
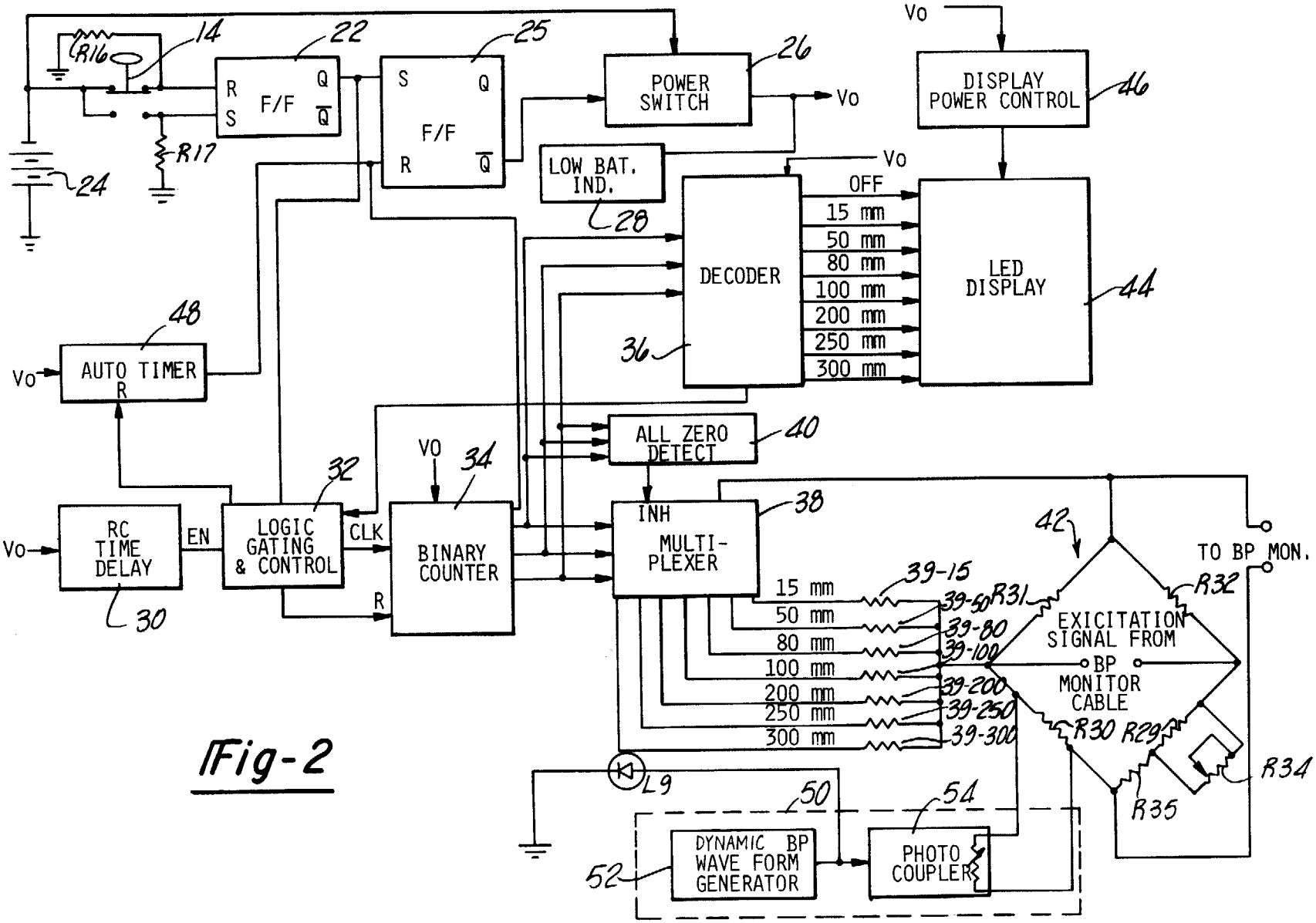
FIG. 2 is a functional block diagram of the preferred embodiment of the electrical circuitry of this invention.
Figure 3:
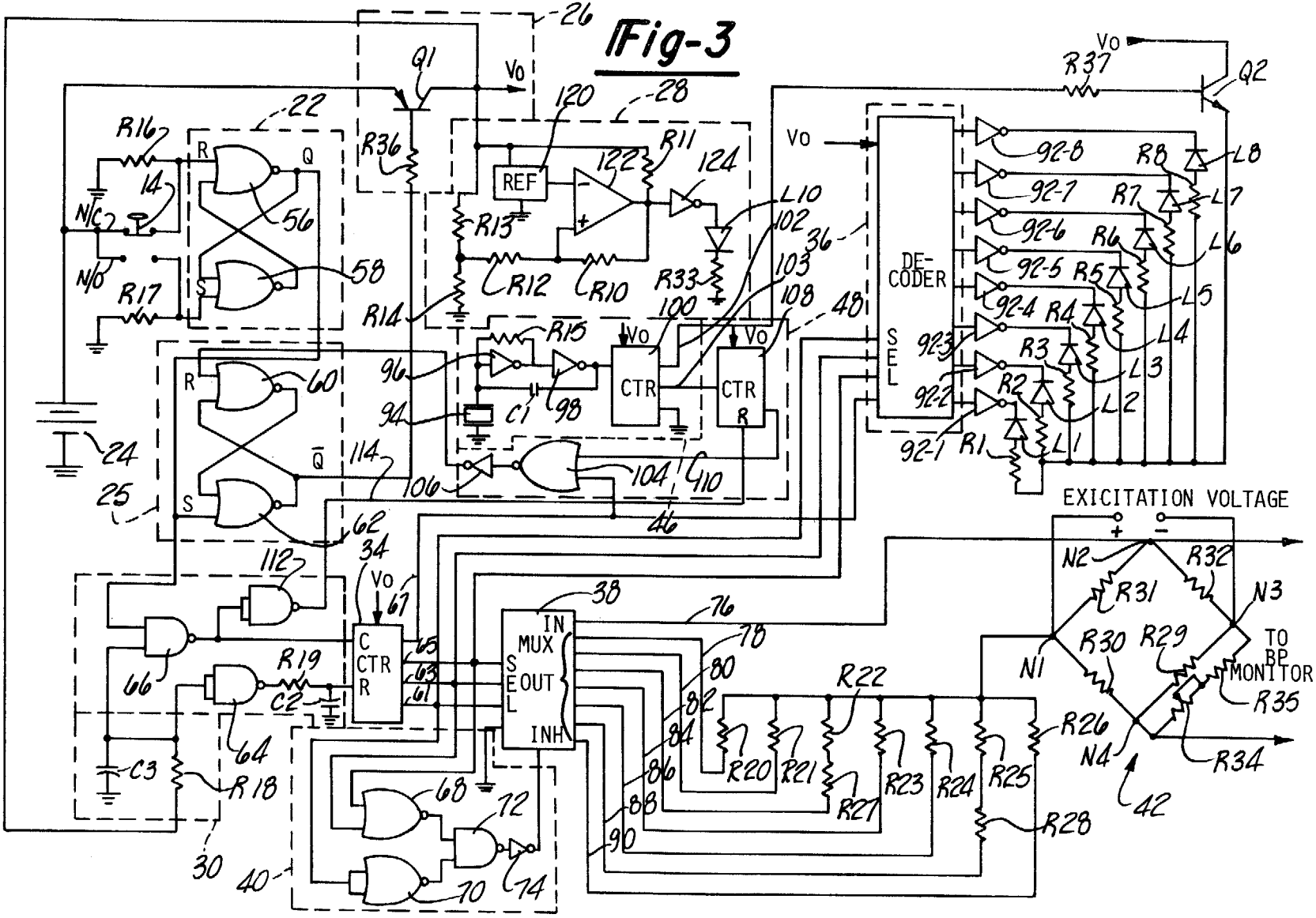
FIG. 3 is an electrical schematic showing the details of the functional blocks shown in FIG. 2.

Referring to FIG. 1, the simulator device 10 of the present invention includes a housing 12 which contains the electrical circuitry shown schematically in FIGS. 2 and 3. A plurality of separate light emitting diodes (LED) L1–L10 are mounted in the top panel of housing 12. LED's L1–L8 correspond to static blood pressure levels of 300, 250, 200, 100, 80, 50, 15 and 0 millimeters of mercury, respectively. The particular static blood pressure level to be generated is selected by sequential activation of selector switch 14. The generated static blood pressure levels are coupled to blood pressure monitor 16 over cable 18. Upon the first activation of switch 14, the device 10 is initialized and the zero LED L8 is activated. The user can calibrate or zero the output of the device 10 by knob 20 which is coupled to appropriate adjustment means within the electrical circuitry to be later described. Further activation of switch 14 sequentially selects signals simulating progressively increasing different static blood pressure levels to be supplied over cable 18 to monitor 16. In such manner, the user may calibrate monitor 16 to the various simulated static blood pressure levels generated by device 10. LED L9 is activated when device 10 is provided with a dynamic waveform generator capability such as that described in the above-identified U.S. Pat. No. 4,205,386 which is hereby incorporated by reference. LED L10 will be energized when the battery power falls below a predetermimed level.

Turning now to FIG. 2, switch 14 is a spring-loaded momentary single pole push button switch which serves, upon each activation to set and then reset RS flip flop 22 by coupling power from battery 24 to its set and then to its reset inputs. The first activation of switch 14 momentarily sets flip flop 22 which, in turn, sets flip flop 25 whose output is coupled to power switch 26 to thereby enable it and supply power Vo to the other electrical components in the circuitry. Low battery indicator circuitry 28 monitors the voltage level of battery 24 and provides a visual indication via LED L10 if the voltage level falls below a predetermined limit.

Binary counter 34 is enabled for receipt of input pulses initiated by switch 14 only after an initializing delay time period determined by RC time delay circuit 30. Binary counter 34 provides a selector code simultaneously to decoder 36 and multiplexer 38. Zero detector circuitry 40 detects a zero output count from counter 34 and inhibits multiplexer 38 so that the device 10 may be initially zeroed by an appropriate adjustment of variable resistor R34. Alternatively, the monitor under test may be zeroed at this time according to procedures provided by the monitor manufacturer. Nonzero outputs from counter 34 cause circuitry 40 to enable multiplexer 38 to couple one of the static level determining resistors 39 into a leg of the interface bridge network 42. Bridge network 42 accepts an excitation signal from the blood pressure monitor 16 at its input. The output of the bridge 42 is coupled to the blood pressure monitor 16. On each subsequent sequential activation of switch 14, a different static level determining resistor 39 is coupled acrossed one leg of bridge 42 to unbalance the bridge and provide an output signal corresponding to the various different static blood pressure levels.

Simultaneously with the generation of the particular simulated static blood pressure level, decoder 36 activates the particular LED in display module 44 associated with the particular simulated static blood pressure level generated.

Display power control circuitry 46 provides duty cycle control for the selected LED such that power dissipation is kept to a minimum.

Automatic timer circuitry 48 coupled to logic control circuitry 32 and flip flop 25 monitors the elapsed time between each switch 14 activation. If the switch 14 is not activated within a predetermined time period, timer 48 will reset flip flop 25 to turn off power switch 26 thereby removing power from the device and prolonging battery life.

A dynamic blood pressure waveform simulator 50 may be included as an option. This option includes a time varying waveform generator 52 which is coupled to another leg of bridge 42 through photocoupler 54. In such manner, the device 10 may provide dynamic waveforms for further enhancing the testing of monitor 16. When the dynamic simulator 50 is in use, LED L9 is activated. Dynamic waveform simulator 50 may be that disclosed in detail in the above-identified U.S. Pat. No. 4,205,386.

Turning now to FIG. 3, the details of the electrical components making up the functional blocks in FIG. 2 will be described. To aid the reader, the components making up the functional blocks are encompassed by dotted lines.

Flip flop 22 is comprised of two cross coupled NOR gates 56 and 58. One input of gate 56 serves as the reset input, with one input of gate 58 serving as the set input for the flip flop 22. The output of gate 56 serves as the Q output which is coupled to one input of a similarly cross coupled NOR gate pair consisting of gates 60 and 62 making up flip flop 25.

When switch 14 is first activated, its plate closes the normally open N/O contacts to set flip flop 22. The Q output from flip flop 22 sets flip flop 25 and causes its $\overline{Q}$ output to fall to a logical zero level. This logical zero level pulls the base of PNP transistor Q1 low thereby turning it on and coupling the power from battery 24 to its collector output labeled $V_o$. While only some of the components in FIG. 3 are labeled with a $V_o$ power input, all of the components except flip flops 22 and 25 and multiplexer 38 are powered by the $V_o$ output from power switch 26.

RC time delay circuitry 30 is utilized to initialize binary counter 34. Until capacitor C3 charges to a predetermined level, the reset input of counter 34 is held at a logical one level via inverter 64 and the clock input is held at a logical zero level by the operation of NAND gate 66. As soon as capacitor C3 charges to the appropriate level, the outputs of gates 64 and 66 change state such that counter 34 will now be capable of providing incremental outputs upon receipt of further clock signals.

When the user releases switch button 14, flip flop 22 is reset thereby placing its Q output in a logical zero state. However, flip flop 25 is not reset, and its $\overline{Q}$ output remains low to keep power switch 26 enabled. Instead, flip flop 25 will be reset only upon receipt of appropriate signals from counter 34 and the auto timer circuitry 48 which will be later described.

Counter 34 is a known binary counter which provides increasing binary count signals on its output lines 61, 63, 65, and 67 upon each receipt of an input clock signal. Counter 34 may be that manufactured by Motorola Semiconductors as Component No. MC14024B. When switch 14 is first activated, counter 34 is initialized such that its output lines provide a count value of zero. The least significant counter output lines 61, 63, and 65 are coupled to zero detector circuitry 40. Detector circuitry 40 includes NOR gate 68, NOR gate 70 wired as an inverter, NAND gate 72, and inverter 74 whose output is coupled to the Inhibit input of multiplexer 38. When zero detector circuitry 40 detects a zero count signal from counter 34 it provides a logical one level to the Inhibit input of multiplexer 38. Multiplexer 38 is an analog switching device which couples input line 76 with a selected one of its output lines 78–90 depending upon the count signal from counter 34 applied to its control or select inputs. Multiplexer 38 may be that manufactured by Motorola Semiconductors as Component No. MC14051B. However, when inhibited, multiplexer 38 does not couple input line 76 to any of its output lines 78–90. This permits the user to zero the blood pressure monitor 16 by an appropriate adjustment.

Output lines 61, 63, and 65 from counter 34 are also coupled to select inputs of decoder 36. Decoder 36 is a BCD to decimal decoder such as that manufactured by Motorola Semiconductors as Component No. MC1402B. Depending upon the count signal on select input lines 61, 63, and 65, decoder 36 selects one of its output lines. As can be clearly seen in FIG. 3, the output lines of decoder 36 are coupled to selected ones of LED's L1–L8. The output lines of decoder 36 each include an inverter/buffer 92 which serves as a current sink for its corresponding LED. When a particular output line from decoder 36 is selected it is driven high and the output of the corresponding buffer inverter 92 is driven low thereby permitting its associated LED to turn on.

When switch 14 is first activated, the count signal on the decoder 36 select input lines causes it to select LED L8 to indicate a zero condition. The anodes of all of the LED's L1–L8 are commonly connected to display power control circuitry 46. Circuitry 46 includes a crystal 94 driving oscillator circuitry comprised of inverters 96, 98 and an appropriate RC network comprised of resistor R15 and capacitor C1. The oscillator network provides clock pulses to a binary counter 100. Counter 100 is a 14 stage binary counter such as that manufactured by Motorola Semiconductors as Component No MC14020B. As is known in the art, appropriate selection of the output pins of such a counter will provide pulses at a particular frequency. Output line 102 from counter 100 provides clock pulses at a frequency of about 60 Hertz. This alternating signal is coupled through transistor Q2 via current limiting resistors R1–R8 to the anodes of all of the LED's L1–L8. This alternating signal provides a 50% duty cycle control for the LED's to thereby minimize power dissipation.

On the next activation of switch 14, the momentary logical one signal on the Q output of flip flop 22 causes gate 66 to transcend to a logical zero level, such transition creating a clock pulse to counter 34 thereby incrementing the count signal on its output lines. Circuitry 40 now detects a nonzero condition and removes the inhibit signal from multiplexer 38. The particular count signal on the select inputs to multiplexer 38 causes it to couple output line 78 to the common input line 76. This causes resistor R20 to be connected in parallel across resistor R31 of bridge network 42. The value of resistor R20 is chosen such that it will unbalance bridge 42 to such extent that its output will provide a voltage level equivalent to 15 millimeters of mercury (mmHg).

Simultaneously with the generation of the 15 mmHg static blood pressure level signal, LED L7 is activated to give the user a visual indication that this particular static blood pressure level is being generated by device 10. This is accomplished in the same manner as previously disclosed in connection with the activation of the zero LED L8. However, since the inputs to decoder 36 now provide a different count signal, LED L7 is energized instead of LED L8.

Upon each next activation of switch 14, counter 34 will again be incremented thereby simultaneously providing control signals to decoder 36 and multiplexer 38 to select a different LED to indicate the new static blood pressure level which is being generated due to the coupling of a different resistor into bridge network 42. Thus it can be seen that the first activation of switch 14 inhibits multiplexer 38 and lights zero LED 8. With each succeeding activation of switch 14, multiplexer 38 couples lines 78–90 to the input line 76 and simultaneously, decoder 36 activates corresponding LED lamps L7–L1, respectively. When switch 14 is pressed after the highest static blood pressure level is generated (300 millimeters of mercury), the power switch 26 is turned off. Most significant output line 67 from counter 34 will go high after counter 34 counts to a binary eight. Output line 67 is coupled through NOR gate 104 and inverter 106 to the reset input of gate 60 in flip flop 25. This causes $\overline{Q}$ output of flip flop 25 to go high thereby turning off transistor Q1 and removing power from the circuit components. The next activation of switch 14 turns on the device 10 and begins an identical cycle as just previously described.

According to another feature of this invention, power switch 26 will also be disabled if selector switch 14 is not pressed within a predetermined time period. This is accomplished by auto timer circuitry 48 which includes a binary counter 108 similar to counter 100. The clock input to counter 108 is coupled to an output of counter 100 which provides clock signals at about a 30 Hertz rate. After a predetermined time period, in this example about five minutes, output line 110 of counter 108 will go high. This signal is coupled to another input of NOR gate 104 and to the reset input of flip flop 25 through inverter 106. Counter 108 is reinitialized or reset whenever push button switch 14 is pressed. This causes counter 108 to begin counting all over again. The resetting of counter 108 is accomplished by logic gating and control circuitry 32. When gate 66 goes low momentarily from switch 14 activation, inverter 112 provides a logical one signal over line 114 which is coupled to the reset input of counter 108.

According to still another aspect of this invention, circuitry 28 is provided for monitoring the power level of battery 24 and generating a visual indication when the battery power level has fallen below a certain reference level. In this particular embodiment, the reference level is about 2.5 volts. This is developed by a voltage reference device 120 such as that manufactured by Analog Devices and known as a 2.5 volt reference device. The output of device 120 is coupled to the inverting input of comparator 122. Resistors R13 and R14 provide a resistor divider network such that when battery 24 develops about 5.5 volts, the node between resistors R13 and R14 will be about 2.5 volts. This node is coupled to the noninverting input of comparator 122. The output of comparator 122 is coupled to LED L10 through inverter 124. Thus, when the actual voltage level from battery 24 falls below about 5.5 volts, LED L10 will be energized to alert the user of the low battery level.

While this invention has been described in connection with particular examples thereof, no limitation is intended thereby except as defined in the appended claims.

The embodiments of the invention in which an exclusive property or privilege is claimed are defined as follows;

1. A device for testing the operability of a blood pressure monitor, said device comprising:

generator means for selectively generating a plurality of output signals, each output signal having a different signal level corresponding to preselected static blood pressure levels for testing the operability of the blood pressure monitor;

a plurality of display devices, each device corresponding to one of the preselected static blood pressure levels;

a push button switch;

control means coupled to said switch, said generator means, and to said display devices, said control means providing control signals operative for simultaneously selecting a different blood pressure level output signal for generation by said generator means and for energizing its corresponding display device upon each sequential activation of the switch.

2. The device of claim 1 which further comprises:

a battery for providing power to the device; and low battery indicator means coupled to the battery, operative to provide a visual indication when the voltage level from the battery has fallen below a predetermined reference level.

3. The device of claim 2 which further comprises timer means for automatically disconnecting said battery from internal device components if said switch is not activated within a given time period.

4. In a device for testing the operability of a blood pressure monitor, said device including a bridge network having a plurality of the resistive legs, an input coupled to an excitation signal from the blood pressure monitor, and an output coupled to the blood pressure monitor for supplying signals to the monitor for testing its operability, the improvement comprising:

a plurality of resistors having one of their ends commonly coupled to one node of the bridge network;

multiplexer means having a plurality of outputs, each of said outputs being coupled to the other end of separate ones of said resistors, said multiplexer means having an input coupled to an adjacent node of said bridge network, and said multiplexor means having control inputs operative to selectively couple one of said outputs to said input thereby selectively coupling one of said resistors across the bridge leg bounded by said nodes, said resistors having different resistive values such that the output of said bridge network provides a plurality of different static blood pressure levels to the monitor for testing the operability thereof;

a plurality of display devices, each device associated with one of the resistors for generating a given static blood pressure level;

decoder means having a plurality of outputs, each output coupled to one of said display devices, said decoder means having a control input for selecting one of said outputs for activating its associated display device;

a single manually selectable push button select switch; and control circuit means coupled between the switch and the control inputs of both said multiplexer and said decoder means, operative to successively select one of said resistors and simultaneously activate the display device associated with the static blood pressure level generated by the selected resistor upon each sequential activation of the switch.

5. The improvement of claim 4 wherein said control means comprises a first counter, operative to increase its output signal count by one for each sequential activation of the switch.

6. The improvement of claim 5 wherein said control means further comprises;

zero detector means coupled between the output of said first counter and said multiplexer, operative to inhibit the multiplexer when the counter output is zero to thereby prevent said resistors from being coupled to said bridge betwork upon initialization of the device to permit zeroing.

7. The improvement of claim 6 wherein said control means further comprises:

a potential source;

a power switch having an input coupled to the potential source and an output coupled to electrical components in the device;

a first flip flop having set and reset inputs coupled for sequential receipt of set and reset signals upon activation of said selector switch, and an output;

a second flip flop having a set input coupled to the output of the first flip flop, and an output coupled to said power switch, operative to enable said power switch upon initial activation of said selector switch whereby power is supplied to the electrical components of the device.

8. The improvement of claim 7 which further comprises:

means for coupling the output of said first flip flop to said first counter for incrementing it upon each sequential activation of the selector switch; and RC delay means for gating said first flip flop output to said first counter after a predetermined time period has elapsed from power being initially applied to the device components whereby to initialize the count signal in said first counter.

9. The improvement of claim 8 which further comprises:

timer means for disabling said power switch after a given time period has elapsed without further activation of said selector switch.

10. The improvement of claim 9 wherein said timer means comprises:

oscillator means for providing a series of pulses;

second counter means having an input coupled for receipt of said pulses from the oscillator means, said second counter having an output coupled to a reset input of said second flip flop for resetting same to thereby disable said power switch when the second counter reaches a given count; and means for coupling the output of said first flip flop to a reset input of said second counter, operative to reset the second counter upon each activation of said selector switch whereby power is supplied to the circuitry as long as the selector switch has been activated before the second counter reaches said given count.

11. The improvement of claim 10 wherein said display devices are light emitting diodes having their associated cathodes separately coupled to an output of the decoder means and having their anodes commonly connected together; and wherein said oscillator means is further coupled to said commonly connected light emitting diode anodes for providing duty cycle control of the ultimately selected light emitting diode thereby minimizing power dissipation thereof.

12. The improvement of claim 11 wherein the source of potential is a battery, and wherein said improvement further comprises:

battery detector means coupled to the battery for detecting a low battery condition and activating a display to indicate said detected condition.

13. The improvement of claim 12 wherein said battery detector means comprises:

a comparator having one input coupled to the output of said power switch and another input coupled to a predetermined voltage level, operative to provide an energization signal at its output to activate the battery detector display device when the voltage level at said one input falls below said predetermined level.

14. Electrical circuitry for initializing and incrementing a counter upon sequential activation of a single push button switch, said circuitry comprising:

a single push button switch;

a potential source;

a power switch having an input coupled to the potential source and an output;

a first flip flop having set and reset inputs coupled for sequential receipt of power from said source upon each activation of said push button switch thereby setting and resetting said first flip flop, said first flip flop having an output;

a second flip flop having a set input coupled to the output of the first flip flop, said second flip flop having an output;

counter means having a clock input for incrementing the count signal output of said counter means, said counter having a reset input for resetting the count signal, and a power input coupled to the output of said power switch for controlling power to the counter means;

means for coupling the output of said second flip flop to the power switch, operative to enable said power switch on the first activation of said selector switch;

delay means coupled to the output of said power switch, operative to provide a reinitializing signal to the reset input of the counter means until a given time period has elapsed from power being initially applied to the counter means; and gating means coupled to the output of said delay means and to the output of said first flip flop, operative to increment the count signal in said counter by providing a pulse to said clock input of the counter means upon each subsequent sequential activation of said selector switch.

15. The circuitry of claim 14 which further comprises:

timer means coupled to a reset input of said second flip flop, operative to reset the second flip flop to thereby disenable said power switch if said selector switch has not been activated within a predetermined time period.

* * * * *